United States Patent [19]

Ohno

[11] Patent Number: 4,730,704

[45] Date of Patent: Mar. 15, 1988

[54] LUBRICATING OIL SUPPLY SYSTEM FOR INDUSTRIAL ENGINES

[75] Inventor: Katsuhiko Ohno, Ohmiya, Japan

[73] Assignee: Fuji Jukogyo Kabushiki Kaisha, Tokyo, Japan

[21] Appl. No.: 847,070

[22] Filed: Apr. 1, 1986

[30] Foreign Application Priority Data

Apr. 4, 1985 [JP] Japan ..... 60-50915[U]

[51] Int. Cl.[4] ..... F01M 1/18; F04B 49/00; G08B 17/06

[52] U.S. Cl. ..... 184/6.4; 184/108; 123/196 AB; 340/594; 417/292; 417/295

[58] Field of Search ..... 184/6.1, 6.4, 108; 417/292, 295; 123/196 AB; 337/362–364; 137/551; 340/594, 606, 610; 374/205

[56] References Cited

U.S. PATENT DOCUMENTS

| | | | |
|---|---|---|---|
| 384,570 | 6/1888 | Grovesteen | 340/610 |
| 1,600,468 | 9/1926 | Hennebohle | 137/551 |
| 1,845,049 | 2/1932 | Jarvis | 337/363 |
| 2,476,998 | 7/1949 | Ogle | 340/594 |
| 2,671,893 | 3/1954 | Van Scoy | 184/108 |
| 3,127,586 | 3/1964 | Heyn | 184/6.4 |
| 3,196,389 | 7/1965 | Heidner | 184/108 |
| 3,717,221 | 2/1973 | Denson | 417/63 |
| 3,772,673 | 11/1973 | Szeverenyi | 340/594 |
| 3,810,143 | 5/1974 | Lawson | 340/594 |
| 4,136,330 | 1/1979 | Estaque | 340/610 |
| 4,193,442 | 3/1980 | Vian | 123/196 AB |
| 4,217,926 | 8/1980 | Van Gorder | 123/196 AB |
| 4,337,737 | 7/1982 | Pechner | 123/196 AB |
| 4,389,630 | 6/1983 | Ubukata | 337/363 |

*Primary Examiner*—Carlton R. Croyle
*Assistant Examiner*—Jane E. Obee
*Attorney, Agent, or Firm*—Martin A. Farber

[57] ABSTRACT

A lubricating oil supply system has a pump for automatically supplying lubricating oil from an oil tank to a crankcase of an engine through a passage. A bimetallic strip is cantilevered on a wall of the passage. The bimetallic strip is provided so as to reduce the cross-sectional area of the passage at the bimetallic strip when the temperature of the strip rises and to increase the cross-sectional area when the temperature lowers.

14 Claims, 5 Drawing Figures

LUBRICATING OIL SUPPLY SYSTEM FOR INDUSTRIAL ENGINES

BACKGROUND OF THE INVENTION

The present invention relates to a lubricating oil supply system for industrial engines, which is capable of automatically supplying lubricating oil when the amount of lubricating oil becomes less than a predetermined level.

Generally, in an industrial engine, it is necessary to supply lubricating oil to a crankcase when the amount of the lubricating oil in the crankcase decreases below the predetermined level due to the consumption of lubricating oil with the operation of the engine. Accordingly, a system which can automatically supply lubricating oil has been employed for this purpose. For example, the assignee proposed in Japanese Utility Model Laid Open No. 55-130008 a lubricating oil supply system for an industrial engine in which pulsation of air pressure in the crankcase is used to vibrate a diaphragm for a pump when the amount of lubricating oil is less than a predetermined level and a necessary amount of lubricating oil is automatically supplied. However, in such a system, the amount of lubricating oil supplied to the crankcase fluctuates due to temperature variation of the oil which is caused by temperature fluctuations of the ambient air and the engine. Namely, at a low temperature, a long time is required to supply a necessary amount of lubricating oil due to an increase of the viscosity of the oil, while at high temperature an excessive amount of the oil is fed due to reduction of the viscosity. Further, such a system of the prior art does not provide any warning or alarm and does not stop the operation of the engine when the temperature of the oil or the diaphragm pump excessively lowers or rises.

SUMMARY OF THE INVENTION

An object of the present invention is to provide a system which can ensure stable supply of lubricating oil and keep a constant oil level within a crankcase of an industrial engine without any influence of fluctuations in temperature of the oil and a diaphragm pump.

Another object of the invention is to provide a lubricating oil supply system for industrial engines which can prevent trouble of the industrial engine by providing a warning system or by stopping the operation of the engine when the temperature of the oil or the diaphragm pump lowers or rises excessively.

The present invention provides a lubricating oil supply system for industrial engines which can supply the lubricating oil into a crankcase by effecting pulsation of air pressure in the crankcase on a diaphragm pump when the level of the oil in the crankcase becomes lower than a predetermined level, wherein a temperature-sensitive control member such as a bimetallic strip is provided for varying the cross-sectional area of a lubricating oil passage for the diaphragm pump, thereby controlling the flow rate of the oil to a constant value.

In the system according to the invention, since a temperature-sensitive control member capable of changing the cross-sectional area of a lubricating oil passage is provided, when the temperature of the oil or the pump which depends on the temperature of the ambient air or the engine lowers or rises, the cross-sectional area of the oil passage is increased or reduced, so that the flow rate of the oil can be kept constant without any influence of the fluctuation of the viscosity of the lubricating oil.

Further, when the temperature of the lubricating oil or the diaphragm pump excessively lowers or rises, the control member operates to close an electric circuit, so as to give a warning or to stop the operation of the engine and thus trouble of the engine may be prevented.

The above and other objects and features of this invention will become understood from the following description with reference to the accompanying drawings.

DETAILED DESCRIPTION OF THE PREFERRED EMBODIMENT

Figure 1:
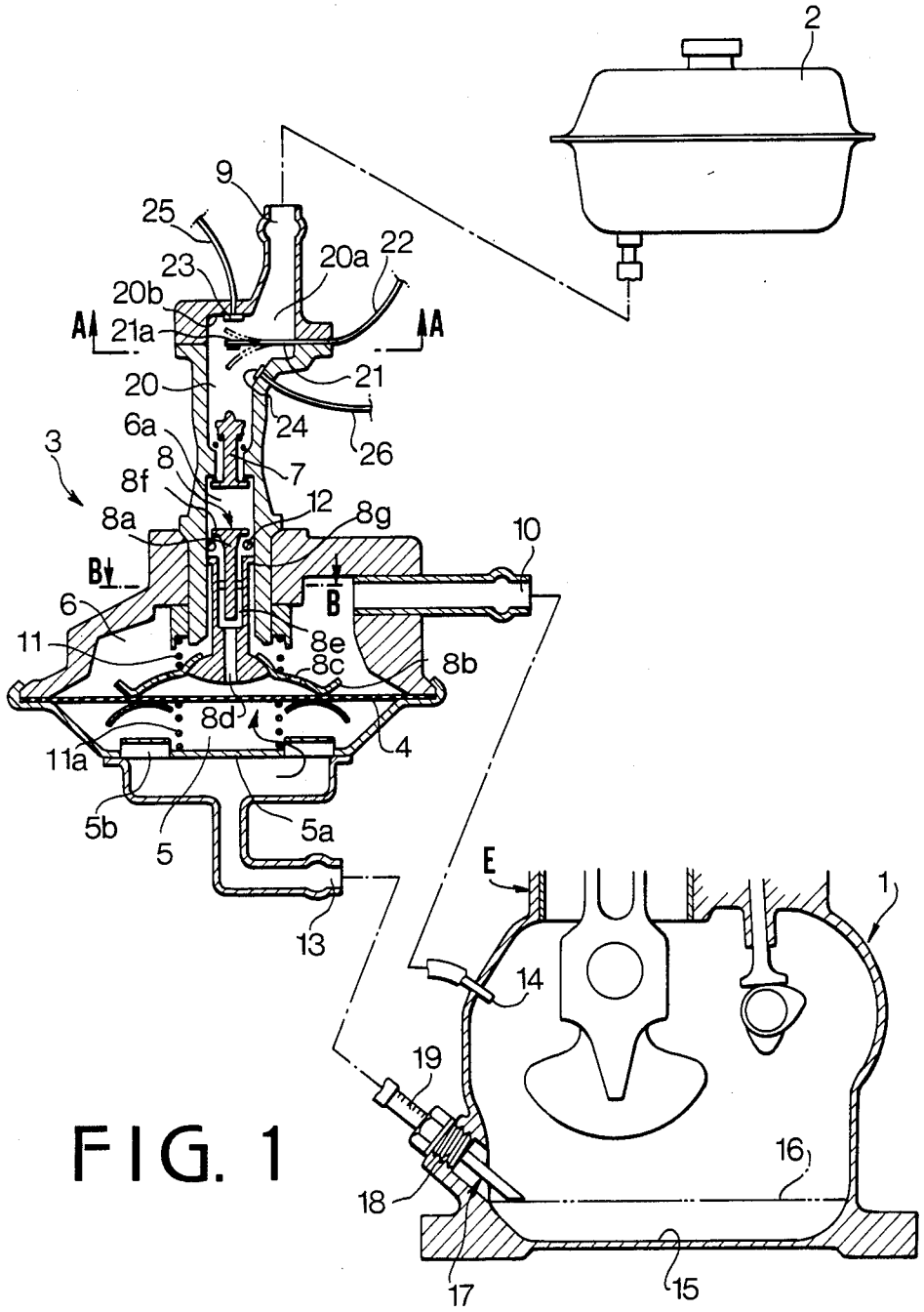
FIG. 1 shows a lubricating oil supply system of the invention, partially in cross section.
Figure 2:
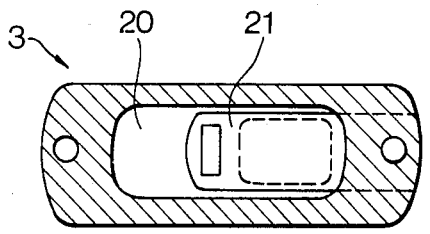
FIG. 2 is a sectional view taken along the line A—A of FIG. 1.
Figure 3:
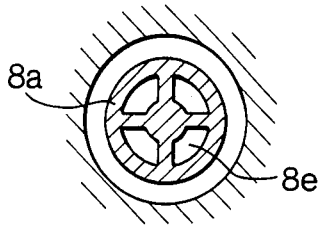
FIG. 3 is a sectional view taken along the line B—B of FIG. 1.

Referring to the drawings, an industrial engine E is provided with a crankcase 1, an auxiliary lubricating oil tank 2 and a diaphragm pump 3. The pump 3 has a diaphragm actuating chamber 5 and a pumping chamber 6 defined by a diaphragm 4. The pump 3 comprises a check valve 7 disposed in the suction side, a check valve 8 placed in the discharge side, an inlet port 9, an outlet port 10 of pump chamber 6, and an intermediate chamber **6*a*. The diaphragm 4 is held by a coil springs 11*a* on a plate 5*a*, and connected to a piston 8*a* of the check valve 8 by an annular plate 8*b* having holes 8*c*. A spring 11 is disposed between the plate 8*b*** and a body of the pump.

The piston **8*a* has an axial passage 8*d* and passages 8*e* communicated with the passage 8*d*, and an O-ring 12 is provided between flanges 8*f* and 8*g* and slidably enaged with the inside wall of the chamber 6*a*. The chamber 5 is communicated with a port 13 through holes 5*b* formed in the plate 5*a*. The port 13 is further communicated with an oil level detecting and pulsation introducing pipe 17. The height of the lower end of pipe 17 can be adjusted by a screw 18 having a scale 19. The outlet port 10 is communicated with an oil supply nozzle 14 in the crankcase 1, and the inlet port 9 is communicated with the auxiliary oil tank 2. The bottom portion of the crankcase 1 forms an oil pan 15 and the lubricating oil is stored in the oil pan 15. The end of the pipe 17 is opened at a position slightly higher than a predetermined oil level 16 which is the required lowest oil level. On the other hand, an oil passage 20 has an expanded chamber portion 20*a* formed between the check valve 7 and the inlet port 9, in which a bimetallic strip 21 is cantilevered on the wall of the passage 20 so as to project into the oil passage 20. The bimetallic strip 21 is arranged to bend toward an inside wall 20*b* so as to reduce the cross-sectional area of the oil passage 20 as shown by broken line 21*a* in FIG. 1, when the temperature of the lubricating oil or the diaphragm pump 3** is elevated. To the contrary, the bimetallic strip bends toward the other inside wall so as to increase the cross-sectional area when the temperature of the oil or the pump is lowered.

Figure 4:
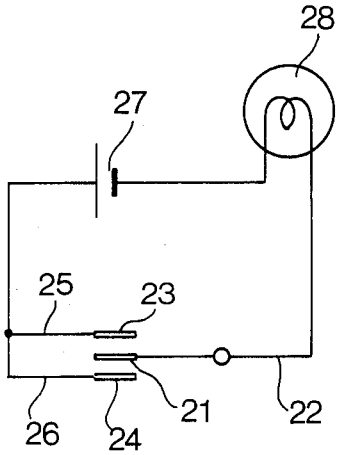
FIG. 4 is a circuit of a warning lamp.

A fixed contact 23 for the higher temperature and a contact 24 for the lower temperature are attached on corresponding positions of the inside wall of the oil passage 20, so that an end 21*a* of the bimetallic strip 21 engages with one of the contacts. As shown in FIG. 4, the contacts 23 and 24 are connected to a battery 27 through leads 25 and 26, and the battery 27 is connected to the strip 21 through a warning lamp 28 and a lead 22.

In operation, when the oil level 16 in the crankcase 1 becomes lower than the predetermined level, which is the level of the end opening of the detecting pipe 17, the pipe 17 is communicated with the space above the oil. Thus, pulsations of pressure in the crankcase 1, which are caused by the reciprocation of the piston of the engine, is transmitted to the diaphragm actuating chamber 5 of the pump 3 to vibrate the diaphragm 4, so that the check valves 7, 8 operate to supply the lubricating oil from the auxiliary oil tank 2 to the crankcase 1. The operation of check valves 7, 8 is as follows.

When the piston 8*a* lowers, the flange 8*f* engages with the O-ring 12 to lower it. Accordingly, the pressure in the chamber 6*a* reduces, so that the check valve 7 opens to induce the oil into the chamber 6*a* from the tank 2. When the piston 8*a* rises, the flange 8*f* disengages from the O-ring 12 and the flange 8*g* engages with the O-ring 12 to raise it. As a result, a passage is formed between the flange 8*f* and the O-ring 12. Thus, the oil in the chamber 6*a* flows into the passage and the passages 8*e* and 8*d* and flows in the crankcase 1 through holes 8*c* and chamber 6.

When the oil level in the crankcase 1 becomes higher than the end of the pipe 17, the opening of the pipe 17 is closed by the oil so that the operation of the diaphragm pump 3 stops.

If the height of the end opening of the pipe 17 is changed by adjusting the screw 18, the level of the oil changes in accordance with the positions of the opening of the pipe 17. Accordingly, the pipe 17, screw 18 and scale 19 serve as an oil level gauge.

When the temperature of the lubricating oil or the diaphragm pump 3 lowers, the cross-sectional area of oil passage is increased by the bending of the bimetallic strip 21, and when the temperature rises, the cross-sectional area is reduced by the bending of the strip 21 in the opposite direction. Thus, the lubricating oil is supplied at a constant flow rate irrespective of a change of the viscosity of the oil. Further, when the temperature of the lubricating oil or the diaphragm pump 3 lowers or rises to a large extent, the bimetallic strip 21 engages with the contact 24 for the lower temperature or with the contact 23 for the higher temperature to close the circuit and to light warning lamp 28.

In the above embodiment, although two pipes 10, 14, 13, 17 are provided for supplying oil and for inducing pressure pulsations, it is possible to provide only one pipe which serves as an oil supply and pulsation inducing pipe.

Figure 5:
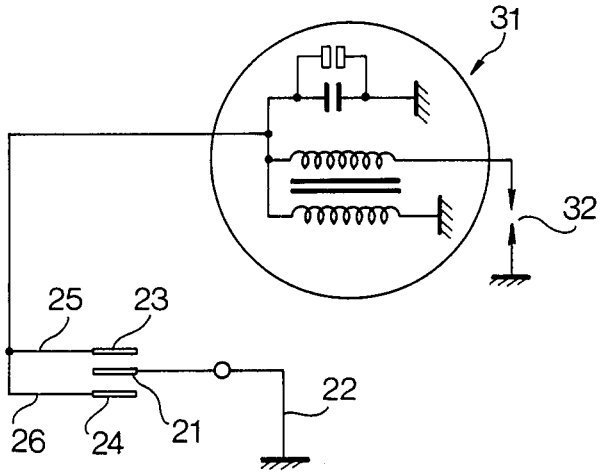
FIG. 5 is a circuit for stopping an engine.

FIG. 5 is a circuit for stopping the engine at abnormal temperatures. In the embodiment of the invention, leads 25, 26 of the contacts 23, 24 are coupled together with a primary winding of a magneto igniting device 31 for a spark plug 32.

In such a construction of this embodiment, when the temperature of the oil or diaphragm pump becomes extremely high or low and the strip 21 engages with the contact 23 or 24, the primary winding of the magneto igniting device 31 is grounded, so that the operation of the engine stops.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A lubricating oil supply system for an engine having a pump for automatically supplying lubricating oil from an oil tank to a crankcase of the engine through a passage, comprising:

a control member comprising a bimetallic strip cantilevered on a wall of the passage so as to reduce the cross-sectional area of the passage at the control member when the temperature of the control member rises and to increase the cross-sectional area at the control member when the temperature lowers; and an electric circuit comprising said strip, a pair of contacts connected in said circuit, a warning lamp, and a battery, in series; and said strip engages respective of said contacts when the strip bends with a change of temperature to respective predetermined upper limit and lower limit temperatures.

2. The system as set forth in claim 1, wherein said contacts are connected in parallel in said circuit and constitute fixed contacts fixed in position in said passage, said strip has a free end, constituting a movable contact, projecting between said fixed contacts, said movable contact engages respective of said fixed contacts when the strip bends with said change of temperature to said respective predetermined upper limit and lower limit temperatures.

3. The system as set forth in claim 1, wherein said pump comprises a spring-biased diaphragm, the latter defining on opposite sides thereof a pumping chamber communicating with said passage and a diaphragm actuating chamber communicating adjacent a bottom in said crankcase with the oil when the level of the oil in the bottom of the crankcase is above a minimum required level, and respectively communicating with ambient inside said crankcase when the level of the oil in the bottom of the crankcase is below said minimum required level such that said diaphragm fluctuates by communicating with said ambient, and piston means connected to said diaphragm for pumping the oil via said pumping chamber into said crankcase when said diaphragm fluctuates.

4. The system as set forth in claim 3, wherein said pump includes an O-ring disposed on a wall of said passage, said piston means is formed with flanges spaced apart, facing each other and operatively cooperating with said O-ring closing said passage and respectively opening said passage.

5. The system as set forth in claim 4, wherein said pump further includes a check valve means disposed in said passage between said strip and said piston means for said opening and closing of said passage in response to pressure change in a chamber defined between said piston means and said check valve means, said O-ring being movably disposed on said said wall of said passage and movable by actuation of said flanges of said piston means.

6. The system as set forth in claim 3, further comprising at least one pipe communicating with said crankcase and with said passage for the supplying of the oil from the oil tank to said crankcase and communicating said crankcase with said diaphragm actuating chamber for introducing pulsations into said diaphragm actuating chamber when the oil level is below said minimum required level.

7. The system as set forth in claim 3, further comprising a pulsation introducing pipe, having a free bottom end opening, projecting into said crankcase adjacent the bottom of said crankcase with said free bottom end opening at said minimum required level, said pipe communicating with said diaphragm actuating chamber.

8. The system as set forth in claim 7, further comprising means for adjusting the amount of projection of said pipe into said crankcase, and a fixed scale cooperating with said pipe.

9. A lubricating oil supply system for an engine having a pump for automatically supplying lubricating oil from an oil tank to a crankcase of the engine through a passage, comprising a control member comprising a bimetallic strip cantilevered on a wall of the passage so as to reduce the cross-sectional area of the passage at the control member when the temperature of the control member rises and to increase the cross-sectional area at the control member when the temperature lowers; and an electric circuit comprising said strip, a pair of contacts connected in said circuit, a magneto ignition device having a primary winding, and a ground, in series; and said strip engages respective of said contacts when the strip bends with a change of temperature to respective predetermined upper limit and lower limit temperatures.

10. The system as set forth in claim 9, wherein said contacts are connected in parallel in said circuit and constitute fixed contacts fixed in position in said passage, said strip has a free end, constituting a movable contact, projecting between said fixed contacts, said movable contact engages respective of said fixed contacts when the strip bends with said change of temperature to said respective predetermined upper limit and lower limit temperatures.

11. The system as set forth in claim 9, wherein said magneto ignition device is operatively connected to said engine such that when said primary winding becomes grounded by said strip engaging respective of said contacts operation of said engine automatically stops.

12. The system as set forth in claim 9, wherein said pump comprises a spring-biased diaphragm, the latter defining on opposite sides thereof a pumping chamber communicating with said passage and a diaphragm actuating chamber communicating adjacent a bottom in said crankcase with the oil when the level of the oil in the bottom of the crankcase is above a minimum required level, and respectively communicating with ambient inside said crankcase when the level of the oil in the bottom of the crankcase is below said minimum required level such that said diaphragm fluctuates by communicating with said ambient, and piston means connected to said diaphragm for pumping the oil via said pumping chamber into said crankcase when said diaphragm fluctuates.

13. The system as set forth in claim 12, wherein said pump includes an O-ring disposed on a wall of said passage, said piston means is formed with flanges spaced apart, facing each other and operatively cooperating with said O-ring closing said passage and respectively opening said passage.

14. The system as set forth in claim 13, wherein said pump further includes a check valve means disposed in said passage between said strip and said piston means for said opening and closing of said passage in response to pressure change in a chamber defined between said piston means and said check valve means, said O-ring being movably disposed on said said wall of said passage and movable by actuation of said flanges of said piston means.

* * * * *